United States Patent [19]

Fischer et al.

[11] 4,122,330

[45] Oct. 24, 1978

[54] ELECTRIC HOT PLATE ASSEMBLIES

[75] Inventors: Karl Fischer, am Gaensberg, D - 7519 Oberderingen, Fed. Rep. of Germany; Felix Schreder, Oberderdingen, Fed. Rep. of Germany

[73] Assignee: Karl Fischer, Fed. Rep. of Germany

[21] Appl. No.: 794,207

[22] Filed: May 5, 1977

[30] Foreign Application Priority Data

May 6, 1976 [DE] Fed. Rep. of Germany ..... 2620004

[51] Int. Cl.[2] ..... H05B 3/68

[52] U.S. Cl. ..... 219/449; 219/452; 219/512

[58] Field of Search ..... 219/448, 449, 450, 452, 219/456, 458, 462, 489, 510, 512

[56] References Cited

U.S. PATENT DOCUMENTS

| | | | |
|---|---|---|---|
| 2,306,979 | 12/1942 | Potsdam | 219/449 |
| 2,311,087 | 2/1943 | Sandll | 219/449 |
| 2,644,874 | 7/1953 | Miller | 219/449 X |
| 2,684,430 | 7/1954 | Bieling | 219/449 |
| 2,691,717 | 10/1954 | Huck | 219/462 |
| 2,813,963 | 11/1957 | Lennox | 219/449 |
| 2,816,203 | 12/1957 | Weeks | 219/489 |
| 4,045,654 | 8/1977 | Eide | 219/449 |

FOREIGN PATENT DOCUMENTS

| | | | |
|---|---|---|---|
| 1,104,087 | 4/1961 | Fed. Rep. of Germany | 219/449 |
| 1,615,258 | 4/1973 | Fed. Rep. of Germany | 219/449 |
| 2,343,834 | 4/1975 | Fed. Rep. of Germany | 219/449 |
| 2,515,905 | 10/1976 | Fed. Rep. of Germany | 219/449 |

*Primary Examiner*—Volodymyr Y. Mayewsky
*Attorney, Agent, or Firm*—J. Rodman Steele, Jr.

[57] ABSTRACT

An electric hot plate assembly including an electrically heated hot plate having one or more electrical conductors disposed therewithin for heating an annular zone of the plate when energized and a device for limiting the operating temperature of the hot plate. A bimetallic element is disposed in a first portion of a housing of the temperature limiting device which projects into an enclosed space located immediately beneath the annular zone of the hot plate. The enclosed space is closed by a cover. A switch, which is adapted to be actuated by the bimetallic element, is located on a base portion of the housing disposed externally of the enclosed space, the first portion and base portion of the housing being thermally insulated from each other. The base portion of the housing carries connecting terminals for connecting the hot plate conductor or conductors to an electrical supply.

25 Claims, 6 Drawing Figures

ELECTRIC HOT PLATE ASSEMBLIES

The invention relates to electric hot plate assemblies and is particularly concerned with such assemblies of the type having a temperature limiter provided with a bimetallic expansion element, which is arranged in an interior space, sealed by means of a cover, immediately below the underside of a heated annular zone of the electric hot plate, and which is provided with a switch, which is operated by means of the expansion element and is attached to a base, on which connecting terminals of the electric hot plate are mounted.

An electric hot plate of this general type is already known from German Pat. No. 1,615,258. In this, the temperature limiter is retained by the cover and is pressed against the underside of the body of the hot plate. The bimetallic expansion element is accommodated in a cavity of the housing. A snap switch, which is operated by means of the bimetallic element via a lever and a thrust member, is also accommodated in the same cavity. The temperature limiter, which is sealed with respect to the underside of the heat source, permits very efficient temperature coupling to the hot plate; however, too high a tripping temperature cannot be selected, as the switch and the bimetallic element are accommodated in the same housing, and the switch would therefore be subjected to excessive thermal stress at high tripping temperatures of the switch. For this reason, the temperature limiter switches at a relatively low heating temperature, but switches off only a fraction, for example 40 percent of the power. The remaining 60 percent of the power cannot then endanger the hot plate directly, but raises the hot plate to so high a temperature that it is not possible to build a shallow hot plate chassis into kitchen furniture. The known temperature limiter is also provided with terminals for the connection of other supply circuits which are not interrupted by the temperature-protective switch. The terminals concerned are tags, which are fitted into the insulating base, and to whose ends, which extend freely outside the housing of the temperature-protective switch, there are connected the leads from the hot plate, and also the cables leading away from the latter.

A temperature limiter is also known from German Pat. No. 2,422,625 in which the switching element on which the snap switch is mounted is accommodated in the unheated central zone of the hot plate, and in which a rod-type temperature sensor extends over and in close proximity to the annular heating zone. This temperature sensor also permits very efficient temperature coupling of the heating temperature; special connecting leads are required for the limiter, however. Electric hot plate assemblies are generally provided with a terminal block having terminals for external connection, which terminal block extends laterally beyond the hot plate, and is fitted to a terminal plate, which is riveted securely to the bottom cover plate of the hot plate. From this terminal block, the connecting leads enter the interior space of the hot plate, defined by the cover plate, via grommets, For the temperature limiter, provided in the central zone, a separate circuit must therefore be provided from the terminal block, or the internal circuit of the hot plate, to the central zone, and back again. Owing to the high temperatures at these points, it is necessary, therefore, to use high-temperature-resistant, and consequently very low-conductivity materials, which are also relatively strong, and are therefore difficult to lay.

It has also already been proposed (German patent application No. P 2,515,905.1 dated Apr. 11, 1975, not yet published) to mount on the terminal plate the switch unit of an hydraulically operated temperature limiter, whose sensing element extends, in the manner of an automatic sensor, through an opening in the centre of the surface of the hot plate, and senses the base of the cooking utensil. In this position, the switch unit is not exposed to undue thermal loading; however, direct coupling to the heating of the hot plate is not provided.

It is an object of the present invention to provide an electric hot plate assembly having a temperature limiter of the type described initially, which, while being easy to manufacture and install provides an improved mode of operation, and allows such high tripping temperatures to be selected that, notwithstanding satisfactory protection of the hot plate during undesirable no-load operation, the hot plate provides optimum performance also in operating ranges of high temperature and power consumption.

In accordance with the present invention, there is provided an electric hot plate assembly including an electrically heated hot plate having one or more electrical conductors disposed therewithin for heating an annular zone of the plate when energised, and a device for limiting the operating temperature of the hot plate, the temperature limiting device comprising a housing, a bimetallic element disposed in a first portion of said housing which projects into an enclosed space located immediately beneath said annular zone of the hot plate and closed by a cover, and a switch adapted to be activated by the bimetallic element and located in a base portion of the housing disposed externally of said enclosed space and thermally insulated from said first housing portion, the base portion of the housing carrying connecting terminals for connecting the hot plate conductor or conductors to an electrical supply.

Advantageously, said first portion of the housing may be open towards the interior space of the hot plate, and/or may have a low thermal capacity.

The invention thus provides an electric hot plate assembly having a temperature limiter, on which the connecting terminals for the electric hot plate are mounted, and whose terminal and switch portion is arranged wholly externally of the interior space defined by the cover plate. Nevertheless, said first portion of the housing may be thermally coupled particularly closely to the electric hot plate, without the necessity for direct contact with the underside of the hot plate.

The invention is described further hereinafter, by way of example, with reference to the accompanying drawings in which.

Figures 1, 2, 6:
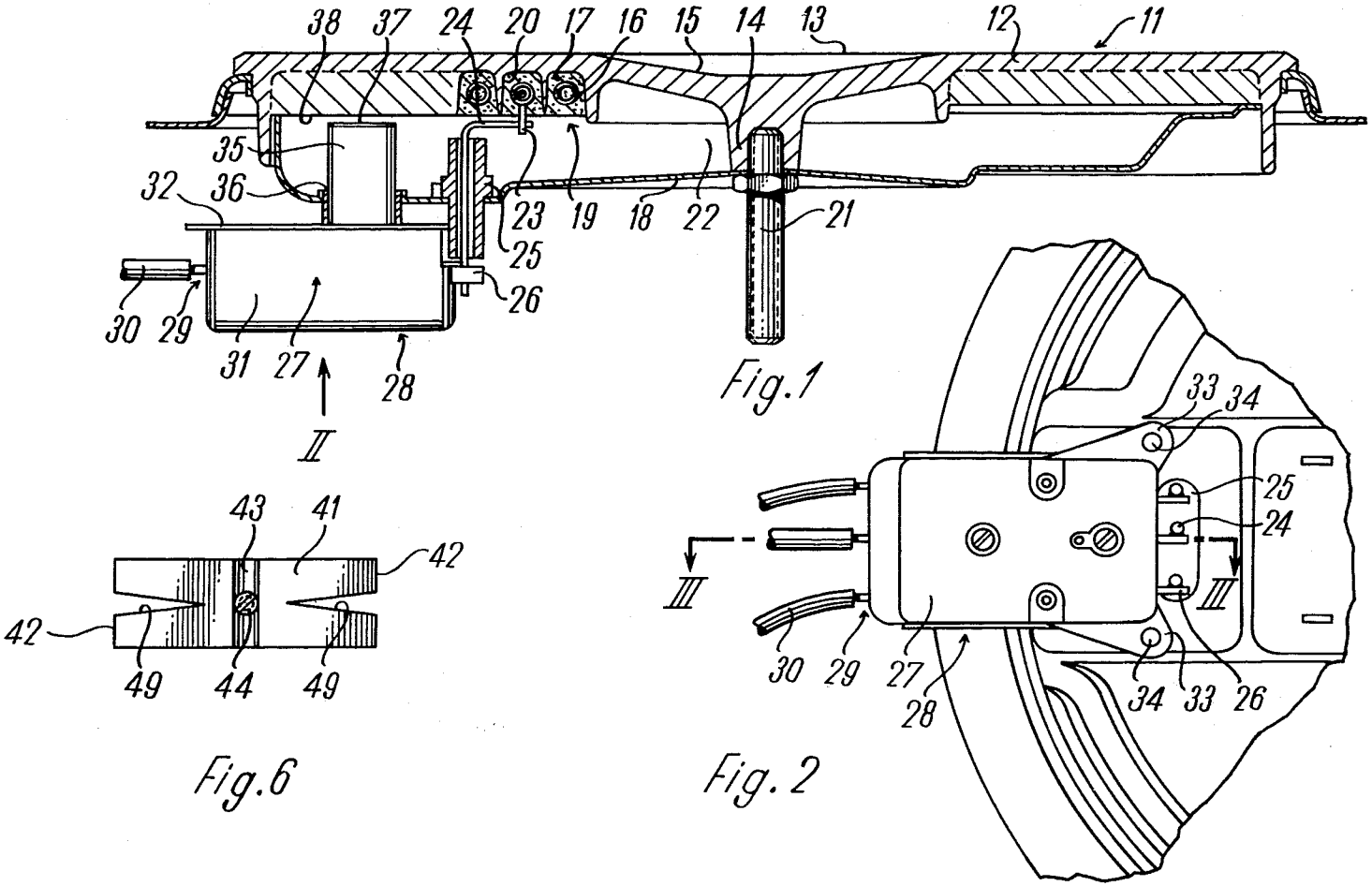
FIG. 1 is a cross-section through one embodiment of an electric hot plate assembly in accordance with the invention in which the temperature limiter is shown in side elevation.
FIG. 2 is a bottom view (in the direction of the arrow II in FIG. 1) of a detail of the assembly of FIG. 1.
FIG. 6 is a plan view of the bimetallic expansion element of the assembly of FIGS. 1 to 5.

The drawings, particularly FIGS. 1 and 2, show an electric hot plate assembly 11, which comprises a hot-plate body 12, of cast material, having a flat upper cooking surface 13 and a relatively depressed unheated central zone 15, in whose underside there is cast a threaded socket 14. The cooking surface zone, that is, the annular heating zone 19 surrounding the unheated central zone 15, is heated by means of spiral heating conductors 16, which are received in an embedding material 17 in spiral grooves 20 on the underside of the hot plate body 12. The underside of the annular heating zone is covered by means of a cover 18, manufactured from pressed sheet metal, which is retained by means of a central pin 21 screwed into the threaded socket 14.

A hot interior space 22 is thus formed between the cover 18 and the underside of the hot plate.

Current is supplied to the heating conductors 16 by way of L-shaped pins 23, which extend outwardly of the embedding material 17 and are welded to connecting wires 24. The connecting wires 24 in the hot plate which are controllable independently of one another and whose number is dependent upon the number of heating conductors (one connecting wire more than the number of heating conductors), are led out through apertures in an insulated grommet, which is fitted in an opening in the cover 18. The connecting wires—three, in the case illustrated (hot plate with two heating conductors)—extend slightly beyond the grommet 25, and are there welded to the ends 26 of supply leads in the form of flat connecting strips.

The base 27 of a temperature limiter 28 is fitted slightly below the cover 18. The base 27 is rectangular in shape, its longitudinal dimension lying radially with respect to the axis of the hot plate. The base 27 extends laterally beyond the edge of the hot plate, and, on its outwardly facing side, there are mounted the electrical connecting terminals 29 of the electric hot plate, into which supply lines 30 from the mains, or from a switching or controlling device, are plugged.

Figure 4:
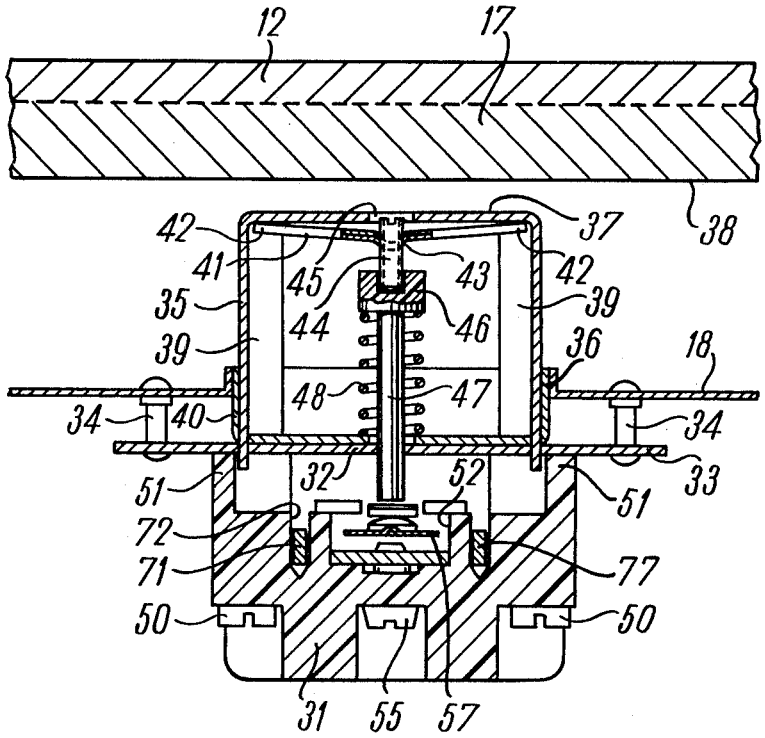
FIG. 4 is a cross-section through the temperature limiter along the line IV—IV in FIG. 3.

The base 27 of the temperature limiter 28 comprises a ceramic insulating member 31 and a sheet-metal plate 32, which faces towards the cover 18 and to which the insulating member 31 is attached. The metal plate 32 has, as shown in FIG. 2, two lateral eyes 33, through which rivets 34 extend and clamp the temperature limiter 28 to the cover 18. As shown in FIG. 4, the rivets 34, the metal plate 32, and hence also the base 27, are spaced several millimeters from the cover 18, in order to minimise heat transfer between the cover 18 and the base 27.

The temperature limiter 28 has a portion 35 which extends upwards from the base member, and whose radial dimensions are substantially smaller than those of the base 27. It extends through an opening 36 in the cover 18, and its upper end 37 lies relatively close to the underside 38 of the embedding material 17 in the annular heating zone 19.

Although the aim is to achieve as close as possible thermal coupling to the underside 38, in the illustrated embodiment there is no contact with the embedding material 17, though this would be possible.

Figure 3:
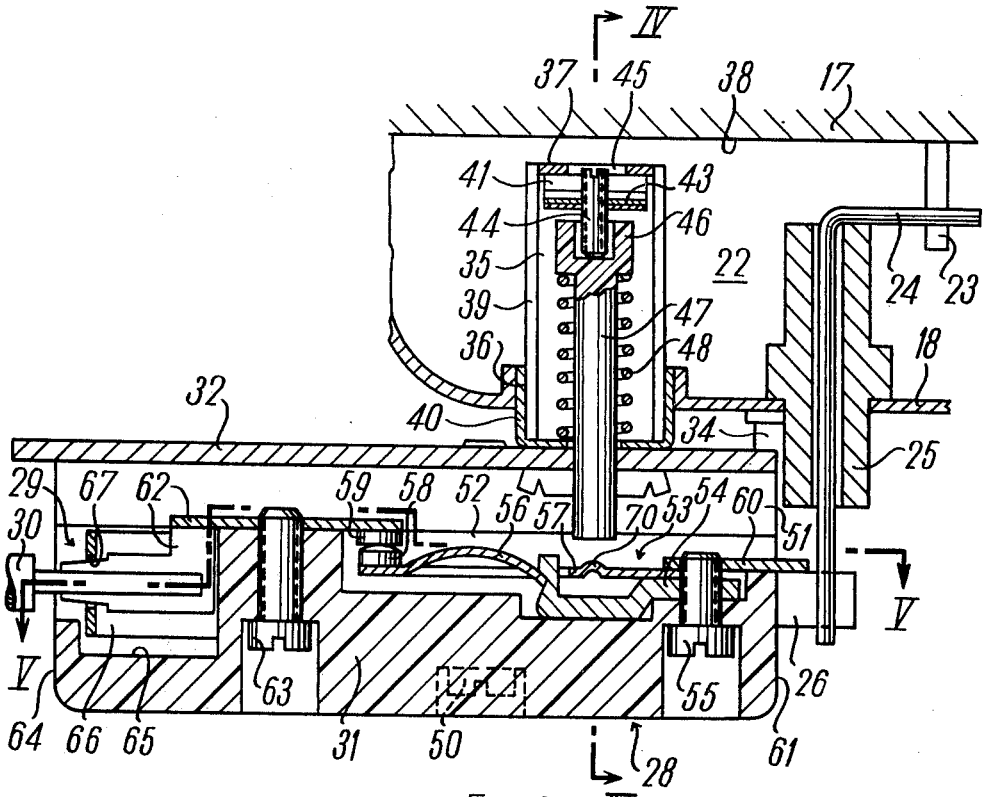
FIG. 3 is an enlarged section through the temperature limiter along the line III—III in FIG. 2.
Figure 5:
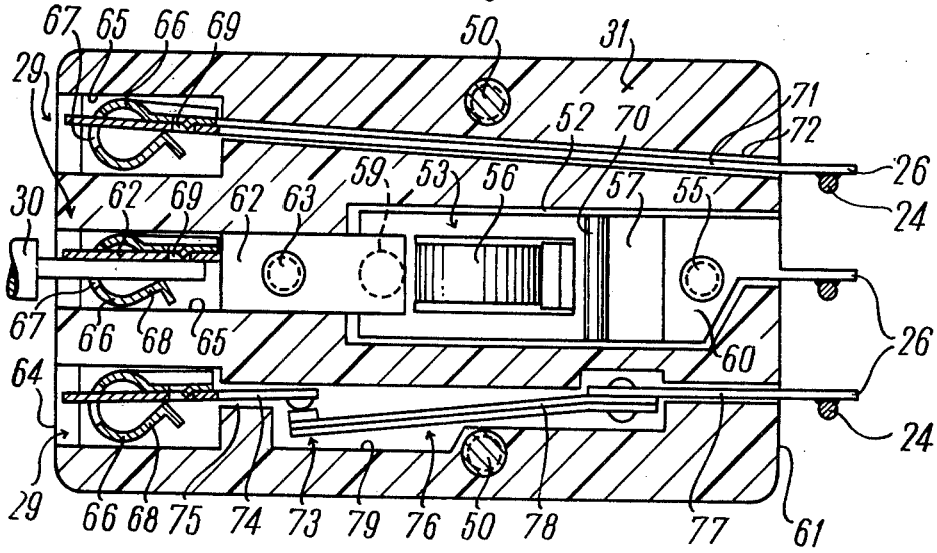
FIG. 5 is a section through the temperature limiter along the line V—V in FIG. 3.

Details of the temperature limiter 28 are shown in FIGS. 3 to 5. As is clearly visible in FIG. 4, the projecting portion 35 comprises an inverted U-shaped sheet-metal frame, the free ends of whose sides extend through the metal plate 32, where they are welded (see FIG. 3). In order to stiffen them, the lateral edges 39 of the two sides are bent inwards, so that the two sides have a U cross-section. A trough-like sheet-metal sealing member 40, whose opening faces upwards and through which the projecting portion 35 extends, is fitted between the frame forming the projecting portion 35 and the metal plate 32. This sealing member 40 fits tightly into the opening 36 in the cover 18, which opening 36 is drawn inwards in the form of a bush, so that the opening 36 is relatively tightly sealed.

In the frame-like portion 35, substantially parallel with its upper end 37, there is provided a bimetallic expansion element 41, the two ends 42 of which abut the upper end of the frame-like portion 35. The bimetallic expansion element 41 is curved slightly downwards, and, at its centre, has a downwardly extending spout-like protrusion 43, which is formed by pressing. A threaded hole, into which an adjusting screw 44 is screwed, is provided in this region in the bimetallic element. The adjusting screw 44 is accessible for adjustment through an opening 45 in the end 37, and engages in an opening in a head 46 of a ceramic thrust rod 47, in a manner to abut and locate the latter centrally. The bimetallic element is prevented from lateral movement between the lateral edges 39, and is urged against the side 37 by a spring 48, which abuts the head 46 and encircles the thrust rod 47.

FIG. 6 shows that the bimetallic element 41 is in the form of a relatively wide strip, from whose ends, or narrow sides, 42, there extend, in the longitudinal direction of the bimetallic element, V-shaped notches 49, whose length is equal to approximately a third of the overall length of the bimetallic element.

The bimetallic element 41, which is supported at both of its ends 42, and whose central region acts upon the thrust rod 47, enables substantial operating forces to be generated when the degree of deflection is sufficiently great. Owing to each end 42 being divided into two relatively narrow strips, support free from rocking is provided, and also transverse bowing, which might otherwise occur, is prevented. Lastly, the bimetallic element also bends transversely. In the manner described, it is possible however, without the transverse flexure having any harmful effect, to use a relatively wide bimetallic strip, whereby the operating force can be increased. The protrusion 43 stiffens the middle of the bimetallic element transversely, and also provides a sufficiently long screw thread for the adjusting screw. The adjusting screw centres the thrust rod 47, which, consequently, does not require any special supporting means at its upper end.

The insulating member 31 is attached to the metal plate 32 by means of screws 50. It abuts the metal plate 32 via lateral, longitudinally extending flanges 51. In its central portion, where a clearance is provided between it and the metal plate 32, the insulating member 31 has a cavity 52 (see FIGS. 3 to 5), in which a snap switch 53 is arranged horizontally. The snap switch 53, which is clamped to the insulating member by means of a screw 55, is of conventional construction, and is provided with a supporting member 54, to which one end of a snap spring 57 is attached, while a spring tongue 56 of the snap spring is supported, under buckling stress, by means of a supporting bearing formed by the supporting member 54. The end of the snap spring 57 remote from the hot plate carries a contact 58, which is normally in abutment with its counter-contact 59. Current is supplied to the snap spring 57 by way of a sheet-metal member 60, of highly conductive material, which forms one of the supply leads, and which extends beyond the inner end of the base nearest to the hot plate, and, by means of a perpendicularly bent portion, forms a terminal lug for the supply leads, to which one of the connecting wires 24 is welded.

The counter-contact 59 also is attached to a flat connecting strip 62, which is clamped to the insulating member 31 by means of the screw 63, and whose end adjacent to the outer end 64 of the insulating member also has a perpendicularly bent portion, which fits into a cavity 65 in the insulating member, and, together with a clamping spring 66, forms one of the connecting terminals 29 for a supply line 30. The clamping spring 66 is in the form of an open loop with a round back, which lies adjacent the outer end 64 of the base and is provided with a slot 67, through which a projecting tag of the connecting strip 62 extends, and through which the supply line 30 is insertable from the outside, thereby forcing back a free portion 68 of the clamping spring 66, which clamps the lead in position and presses it in tight contact with the connecting strip 62. The clamping spring is clamped to the connecting strip by means of a tag, which engages in a hole 69 in the connecting strip. The type of terminal connection corresponds to that described in German Pat. No. P 2,553,559.

The thrust rod 47, which extends vertically through holes in the sealing member 40 and the metal plate 32, which holes provide a relatively tight seal with respect to the thrust rod 47 and guide it, acts upon the operating pressure point 70 of the snap spring 57. The thrust rod, which is manufactured from ceramic material and is therefore both a thermal and an electrical insulator, is urged by the pessure of the spring 48, with a predetermined pre-loading force, via the adjusting screw 44 against the bimetallic element 41. Consequently, as shown in the drawings, in the cold state a clearance exists between the thrust rod and the pressure point 70 of the snap switch.

FIGS. 4 and 5 show that on one side of the snap switch 53, a supply lead 71, in the form of an upright flat connecting strip, extends in a slot 72 in the insulating member 31, longitudinally through the base, and, at the outer end 64, is provided with a plug-type connecting terminal 29. The inner end 26 is welded to one of the connecting wires 24.

A supply lead 73 also extends longitudinally through the base on the other side of the snap switch 53. It comprises a connecting strip 74, which also is placed edge uppermost in a slot 75, and which is fitted with a plug-type connecting terminal 29, a bimetallic switch 76, and a connecting strip 77, also arranged edge uppermost in the region of the inner end 61 of the base, its end 26 being welded to a connecting wire 24. The bimetallic switch is of very simple construction. As shown in the drawings, the bimetallic element 78 itself acts as a conductor; alternatively, however, it may be arranged separately. In any case, however, it is sufficient if the switch 76 opens without a snap action, that is, provides slow-action contacting, this switch, housed in a cavity 79, being provided only as a safety switch in the event of failure of the switch 53.

The method of operation of the electric hot plate with its temperature limiter is as follows: Normally, the switches 53 and 76 are closed. When the electric hot plate is heated, the temperature of the bimetallic expansion element 41 follows closely the rising temperature of the electric hot plate, since, owing to the parallel disposition of the bimetallic element 41 in close proximity to the underside 38 of the annular heating zone 19, efficient heat transfer takes place. Owing to its frame-type sheet-metal construction, the portion 35 has a relatively low heat-absorption capacity, so that there is no danger of a time lag in heating-up. Moreover, the laterally open frame ensures a direct exchange of convected heat with the hot interior space 22. The relatively tight seal and the small heat-conducting surfaces between the portion 35 and the base 27 not only ensure that the bimetallic expansion element 41 follows the heating temperature closely, but also prevents the base 27 from becoming further heated. Except for the narrow projecting portion 35, air circulates all round this base, so that its temperature is very much lower than the temperature of the interior space 22. When the tripping temperature selected by means of the adjusting screw 44 is reached, the thrust rod 47 exerts pressure on the operating point 70 of the snap switch, and the contacts 58, 59 open. The lead controlled by the switch 53 is preferably the common supply lead, so that both heating conductors 16 are then switched off. When subsequent cooling occurs, the bimetallic element 41 again follows the drop in temperature very quickly. Because, owing to the low flexibility of the bimetallic element and the direct transmission of pressure to the snap switch, whose contact travel can amount to only one hundredth of a millimeter, the temperature limiter has a very low switching hysteresis, the temperature limiter switches on again several degrees below the selected limiting temperature, so that it is possible to maintain this limiting temperature. This is not by any means commonplace in temperature limiters. Temperature limiters less well coupled to the heat show substantial time-dependence, and they would not therefore switch the heat on again until long after switching off. This would not, as in the present case, enable the heat to be switched off completely, as, in that case, it would no longer be possible to work with the hot plate.

In the case of the illustrated embodiment, it has been established that the hot plate, when switched to full-load output, was turned down to quarter capacity by means of the temperature limiter in its steady state, as the temperature limiter released the power for only a quarter of the time, but at such intervals that no substantial variation of the relatively high limiting temperature selected occurred. This ensures, first, that the hot plate is able to meet all normal requirements, particularly high power consumption when cooking at high temperatures (frying), and secondly, that the temperature is limited so accurately that it is possible to install the hot plate in very shallow hot plate chassis (minimum height required only 3 cm), even when the latter are to be installed close to combustible elements such as kitchen furniture. The switch 76 has only one safety function, namely, in the event of failure of the switch 53 for any reason. It senses the temperature of the base, and does not normally switch off.

Apart from the functional advantages mentioned above, the described temperature limiter also provides numerous advantages with regard to its manufacture. It is an integral, finish-preassembled component, which can be preadjusted and integrated into the production cycle during manufacture of the hot plate. It has a multiple function, as it serves simultaneously as the junction block, which is necessary in any case, and as the temperature limiter. It is accordingly unnecessary to connect special supply leads to the temperature limiter, which simplifies assembly substantially. Owing to the low temperature of the base member, due to the insubstantial heat bridges and to its external location, it is possible for the terminals to be in the form of plug-type terminals, which would not function satisfactorily at high temperatures. Moreover, the switches 53 and 76 are located in a region of low temperature, where they operate very reliably. Connection of the supply leads to the hot plate is also improved. Such high temperatures normally prevail in the region of the interior space 22, that not only the connecting pins 23, but also the connecting wires 24 must be manufactured from high-temperature material such as chrome nickel. In conventiional arrangements, these connecting wires are then connected through to the terminals. Owing to the fact that they needed to make a number of turns, they had to be of relatively thin material. This material is, however, a resistive material, which is itself heated by the high-amperage currents conducted, so that these connecting wires reached temperatures of approximately 250° C., owing purely to self-heating. Consequently, they heated the terminal block, and thus transmitted the temperature of the hot plate to the outside. The result was that the plug-type terminal connections were severely affected by temperature.

In the illustrated embodiment in accordance with the invention, the connecting wires 24 need only be very short, so that they may also be manufactured from thicker materials. Especially, howver, they terminate immediately at the point where they leave the hot zone, and are then welded to the leads in the form of connecting strips. However, these leads are situated in a region of relatively low temperature, namely in the base, and may therefore be manufactured from materials such as iron or nickel, having a conductivity roughly ten times that of the high-temperature materials described. Their self-heating due to current conduction is insubstantial. Hence also, however, the terminals remain in a region of low temperature, and, for ease of working, may be in the form of plug-type connections. It will be appreciated that attachment of the temperature limiter to the virtually fully assembled hot plate is very simple. The preassembled temperature limiter is placed with its projecting portion 35 through the opening 36, and is riveted in position by means of the two rivets 34. The connecting wires 24, extending outwardly of the insulating lead-out 25, are then welded by means of welding tongs to the ends of the supply leads 26, which is a very simple operation, these ends being freely accessible. Alternatively, as a protection against accidential contacting, it is possible to lay these ends in laterally open compartments in the base. They are then protected against accidental contacting, but are still easily accessible to correspondingly shaped welding tongs. In any case, it is important that the leads 60, 62, 71, 73 be insulated as a protection both against contacting from below, and also with respect to the hot plate.

The tripping temperatures may be adjusted so that a temperature level of 280° to 350° C. can be maintained in a utensil placed on the hot plate. This is substantially higher than has been possible with temperature limiters hitherto. Approximately the same hot-plate temperature level is, however, maintained also when the utensil is removed. These excellent properties of the temperature limiter, together with its simple construction and its dual function as a limiter and a junction block, enable it to be fitted also to hot plates which are provided additionally with a temperature-dependent control element, for example automatic hot plates having a central hydraulic sensor. Fundamentally, these hot plates are at best protected by the hydraulic sensor against overheating. All the same, in the highly unlikely event of a leak in the hydraulic system, the temperature could rise out of control. Another consideration, however, and one which can never be entirely discounted, is the possibility of a mix-up of the individual sensor capsules during assembly or when a cooker is being repaired. As the switch is normally left on the cooker, and the sensor capsule is removed on the removal of the hot plate, such confusion is possible. In this event, the automatic sensor loses its limiting function, and damage may occur. When used as a terminal element, a temperature limiter in accordance with the invention would be provided with additional safety means in order to prevent such an error. The switch 76 is not necessary in all cases.

We claim:

1. An electric hot plate assembly including an electrically heated hot plate having at least one electrical conductor disposed therewithin for heating an annular zone of the plate when energised, cover means defining an enclosed space located immediately beneath said hot plate and secured thereto, and a device for limiting the operating temperature of the hot plate, the temperature limiting device comprising a housing, a bimetallic element disposed in a first portion of said housing which projects into said enclosed space at a location beneath said annular zone, said first portion of the housing having a low thermal capacity, the housing having a base portion disposed externally of said enclosed space, means thermally insulating said base portion from said first housing portion, connecting terminals located in the base portion of the housing for connecting said at least one hot plate conductor to an electrical supply, and switch means located in said base portion of the housing and adapted to be actuated by the bimetallic element.

2. A hot plate assembly in accordance with claim 1, in which said first portion of the housing has an opening communicating with said enclosed space.

3. A hot plate assembly in accordance with claim 1 in which said first portion of the housing is adapted to be inserted, during assembly, from outside through an opening in said cover.

4. A hot plate assembly in accordance with claim 1, comprising supply leads accommodated in said base portion of the housing for coupling said terminals to said at least one conductor.

5. A hot plate assembly in accordance with claim 4, comprising supply leads connected externally of the cover to connecting wires leading to said at least one conductor, of the hot plate, which connecting wires extend outwardly through said cover.

6. A hot plate assembly, in accordance with claim 5, in which the supply leads are manufactured from material having a higher electrical conductivity than said connecting wires.

7. A hot plate assembly in accordance with claim 1, in which said base portion extends outwards from the edge of said hot plate in the manner of a side terminal, and in which said electrical connecting terminals of said hot plate are disposed at its outer end.

8. A hot plate assembly in accordance with claim 7, in which said base portion extends laterally beyond the periphery of said hot plate.

9. A hot plate assembly in accordance with claim 5 in which said supply leads of the hot plate extend side by side through said base portion of the housing, substantially radially relative to the hot plate, and in which, at their inner ends, said supply leads are welded to said connecting wires.

10. A hot plate assembly, in accodance with claim 4 in which said supply leads in said base portion are in the form of flat connecting strips.

11. A hot plate assembly in accordance with claim 4 comprising a switch connected in at least one of said supply leads.

12. A hot plate assembly in accordance with claim 1 in which said connecting terminals of the hot plate are in the form of plug-type connections.

13. A hot plate assembly in accordance with claim 1 in which said first portion of the housing of said temperature limiting device is arranged in the region of the periphery of said annular heating zone of the hot plate, a short distance from the underside of the hot plate.

14. A hot plate assembly in accordance with claim 1 comprising a thrust rod which extends between said first portion and said base portion of the housing and by which said bimetallic element acts upon said switch means.

15. A hot plate assembly, in accordance with claim 14, in which the bimetallic element comprises a bimetallic strip, whose two ends abut said first portion of the housing, and whose central region acts upon said thrust rod.

16. A hot plate assembly in accordance with claim 15, in which said bimetallic strip is slotted at its two ends.

17. A hot plate assembly in accordance with claim 15 comprising a protrusion in the central region of said bimetallic strip and an adjusting screw for acting upon said thrust rod.

18. A hot plate assembly in accordance with claim 17, in which said thrust rod is located centrally by means of said adjusting screw.

19. A hot plate assembly in accordance with claim 13 in which said thrust rod is spring-loaded in a direction towards said bimetallic strip.

20. A hot plate assembly in accordance with claim 1 in which said first portion of the housing comprises a substantially U-shaped sheet-metal yoke, having a top portion which extends parallel with the underside of said hot plate and against which said bimetallic strip abuts.

21. A hot plate assembly in accordance with claim 1 comprising sealing means attached to said base portion for sealing the aperture in the cover through which said first housing portion extends.

22. A hot plate assembly in accordance with claim 21, in which said sealing means comprises a trough-shaped, sheet-metal member, which is open at the top.

23. A hot plate assembly, in accordance with claim 1 in which said base portion of the housing is attached to said cover such that a clearance is provided therebetween.

24. A hot plate assembly in accordance with claim 1 in which said base portion comprises an insulating member, in which said switch means and a plurality of supply leads are accommodated, and a sheet-metal plate, which lies adjacent to and is connected to said cover.

25. A hot plate assembly in accordance with claim 1 comprising an additional safety limiter-switch which is located in said base portion of the housing and which is integrated in a supply line and includes a further bimetallic element.

* * * * *